US006019180A

United States Patent [19]

Pafitis et al.

[11] Patent Number: 6,019,180

[45] Date of Patent: Feb. 1, 2000

[54] METHOD FOR EVALUATING THE POWER OUTPUT OF A DRILLING MOTOR UNDER DOWNHOLE CONDITIONS

[75] Inventors: Demosthenis Pafitis, Houston; Vernon Koval, Rosenberg, both of Tex.

[73] Assignee: Schlumberger Technology Corporation, Sugar Land, Tex.

[21] Appl. No.: 09/069,525

[22] Filed: Apr. 29, 1998

Related U.S. Application Data

[60] Provisional application No. 60/045,631, May 5, 1997.

[51] Int. Cl.[7] ..... E21B 44/00

[52] U.S. Cl. ..... 175/38; 175/48; 173/177; 137/624.18; 222/262

[58] Field of Search ..... 175/26, 38, 48; 299/19; 137/624.18; 173/177; 222/262

[56] References Cited

U.S. PATENT DOCUMENTS

| | | | |
|---|---|---|---|
| 4,059,309 | 11/1977 | Cleary | 299/18 |
| 4,359,898 | 11/1982 | Tanguy et al. . | |
| 4,434,858 | 3/1984 | Whitehouse | 173/177 |
| 4,608,861 | 9/1986 | Wachtler et al. . | |
| 4,685,329 | 8/1987 | Burgess . | |
| 4,805,449 | 2/1989 | Das . | |
| 4,821,563 | 4/1989 | Maron . | |
| 4,843,875 | 7/1989 | Kerbart . | |
| 4,852,399 | 8/1989 | Falconer . | |
| 4,981,036 | 1/1991 | Curry et al. . | |
| 4,991,663 | 2/1991 | Steverding | 173/177 |
| 5,216,917 | 6/1993 | Detourney . | |
| 5,346,021 | 9/1994 | Braunlich | 173/177 |
| 5,368,108 | 11/1994 | Aldred et al. . | |

OTHER PUBLICATIONS

I.G. Falconer et al., "Separating Bit and Lithology Effects from Drilling Mechanics Data", IADC/SPE Conference Paper 17191, Dallas, Texas, Feb. 28, 1988.

Robbins and Myers, Inc., "MOYNO Down–hole Motors" Specification Data, Dec. 15, 1990.

W. Tiraspolsky, *Hydraulic Downhole Drilling Motors: Turbodrills and Positive Displacement Rotary Motors*, Gulf Publishing Company, Houston, 1985, pp. 223–229.

*Primary Examiner*—Roger Schoeppel

*Attorney, Agent, or Firm*—Darcell Walker; Wayne I. Kanak; Steven L. Christian

[57] ABSTRACT

A procedure is described for determining the power output of a downhole drilling motor, when the motor is inside the wellbore. The technique uses stand-pipe pressure and fluid flow rate as the main inputs. The power output of the motor is calculated by carrying out two low flow stall tests at flow rates lower than the drilling flow rate. These tests result in "off-bottom" and stall pressures at the two flow rates. Another off-bottom pressure is taken at the actual flow rate that will be used during drilling operations. From the use of the off-bottom and stall pressure measurements, a determination is made of the differential pressure across the motor and the stall pressure at the actual drilling fluid flow rate. A full power curve and a predicted operating stand-pipe pressure for optimal power generation are provided based on an experimentally verified assumption regarding the change in rotation rate of the motor versus the differential pressure across the motor power section.

18 Claims, 5 Drawing Sheets

METHOD FOR EVALUATING THE POWER OUTPUT OF A DRILLING MOTOR UNDER DOWNHOLE CONDITIONS

CROSS-REFERENCE TO RELATED APPLICATION

This application claims priority from Provisional Application No. 60/045,631, filed on May 5, 1997, the contents of which are incorporated herein by reference.

BACKGROUND OF THE INVENTION

1. Field of the Invention

This invention relates generally to a method for evaluating the performance of a drilling motor under downhole conditions. In particular, it relates to a method for evaluating the power output of a drilling motor and using this evaluation data to optimize the performance of the motor during downhole drilling operations.

2. Description of the Related Art

A drilling motor is a mechanical tool based on a progressive cavity device similar to the positive displacement pump first reported by Moineau and is used to drive a drill bit for directional drilling of wells. A drilling motor operates by translating the flow of pressurized drilling fluid (mud) into the rotation of a helical rotor, within a similar lobed-type stator. FIG. 1 shows the cross-section of a typical drilling motor used in the context of the present invention. Drilling fluid flows through area 10, causing the helical rotor 11 to rotate around the lobes 12 in the stator 13. The motor has a maximum mechanical power output. When the motor approaches this maximum power output, any additional hydraulic power supplied to the motor is dissipated by deformation of the stator lobes which are typically formed of a rubber compound. A deformed stator in the motor results in a reduced rate at which the drill bit, connected to the motor, penetrates the formation.

In order to use the motor optimally in terms of the translation of hydraulic power into mechanical power at the drill bit, and to decrease the chances for stator deformation, it is necessary to know the downhole characteristics that affect the power output of the motor under downhole conditions. The downhole characteristics of interest include weight-on-bit (WOB), torque, motor shaft speed and the pressure drop across the motor's power section. Measurements of these characteristics are preferably made downhole and in a continuous manner so that they are representative of actual values. Downhole measurements of such characteristics are usually transmitted uphole, by a measurment-while-drilling (MWD) tool, for processing and display at the surface in substantially real-time. Based on calculations from these measurements, operators can adjust drilling parameters and, therefore, maximize the mechanical power output of the motor and the rate of penetration of the drill bit while reducing wear on the stator to a minimum. Typically, the power output of the motor is reported as a function of the pressure drop across the motor. However, this power data is most often generated for the motor under surface conditions and therefore may be an inaccurate representation of the motor characteristics in downhole environments.

By utilizing calibration techniques, it is possible to determine the power output of the motor under downhole conditions and thus use such data to optimize the operating parameters of the motor. Furthermore, by evaluating the power output of the motor over a period of time, it is possible to determine any degradation of motor performance and indicate a suitable stage at which the motor is no longer economical to operate.

U.S. Pat. No. 5,368,108 describes one method for optimizing the performance of a downhole drilling motor. This patent describes a method for determining the maximum power output of a downhole drilling motor and the hydraulic power that is input to the motor. Hydraulic power input and maximum power output are plotted versus one another to obtain a characteristic curve. The mechanical power output is proportional to downhole torque on the drill bit and to the rotary speed (RPM) of the bit. Torque and RPM are measured continuously downhole and the measurements transmitted to the surface. The hydraulic power input to the motor is a function of pressure drop across the motor and the flow rate therethrough. A plot of the mechanical power output with increasing hydraulic power input has a predictable shape, assuming a constant flow rate. The optimum power output occurs when the slope of this plotted curve is no longer positive, that is, the value thereof reaches a maximum and will shortly begin to decline.

The technique described in the '108 patent uses the power curve to obtain the optimum power output, and thus the optimum torque value. The optimum power output can be compared with the theoretical value from motor specifications to determine the effects of wear and temperature on the motor performance. The optimum downhole weight-on-bit is computed for the optimum torque value since there is a linear relationship between downhole torque and weight-on-bit for a given lithology. Such optimum weight-on bit is computed in real time, together with a representation of the power curves, to indicate the position on such curves for the driller. The optimum rate of penetration can be determined, since rate of penetration is a linear function of the mechanical power output of the motor. The optimum mechanical power output has a corresponding hydraulic power input from which an optimum standpipe pressure can be determined.

Although the method of the '108 patent is effective, this method still requires the task of actually taking downhole measurements such as motor torque and motor RPM. This method also requires additional downhole equipment to take the measurements. The present invention is a procedure for predicting the power output by the motor from measurements taken at the surface instead of downhole. This information is useful in determining motor performance and assessing motor deterioration.

SUMMARY OF THE INVENTION

It is an object of this invention to provide a method to optimize the performance of a drilling motor during downhole drilling operations.

It is another object of this invention to determine motor performance without the need to take measurements of characteristics such as torque and weight-on-bit during downhole drilling operations.

It is another object of this invention to calculate the pressure at which a drilling motor will stall during actual drilling operations.

It is another object of this invention to determine, at the surface, the pressure drop across the motor when the motor is stalled.

It is yet another object of this invention to determine the maximum power output of the motor.

The present invention is a method for determining the power output of a downhole drilling motor during drilling operations. The method uses stand-pipe pressure and fluid flow rates as the main information to determine the motor power output. The stand-pipe pressure is the total pressure required to pump drilling fluid from the surface, down the borehole through the drilling motor and drill bit and back to the surface equipment. The power output of the motor is calculated by carrying out two stall tests at flow rates lower than the actual drilling flow rate. These tests result in "off-bottom pressure" and "stall pressure" information at two different flow rates. The use of the off-bottom and stall pressure measurements permits the calculation of an operating stand-pipe pressure for optimal power generation. This power generation is based on an experimentally verified assumption regarding the change in rotation speed of the motor versus the pressure differential (also called the pressure drop) across the power section of the motor.

In this method, the motor is run at off-bottom and on-bottom positions in the borehole for the same low fluid flow rate. This step produces a measurement of the stand-pipe pressure off-bottom and the stall pressure at bottom. The next step is to increase the flow rate and determine the off-bottom stand-pipe pressure and stall pressure at the higher flow rate. This increased flow rate is higher than the first flow rate, but lower than the actual flow rate of the drilling operation. Once the measurements at the second flow rate are complete, the next step is to measure the off-bottom pressure at the actual drilling flow rate. This task requires pumping fluid at the required drilling flow rate and running the motor off-bottom to obtain the actual off-bottom pressure during drilling. A pressure differential across the motor under actual drilling conditions is then calculated from the measured off-bottom and stall pressures at the lower flow rates and the off-bottom pressure at the actual drilling flow rate. The stall pressure of the motor (stand-pipe pressure at stall) is the sum of the pressure differential and the stand-pipe pressure off-bottom at the actual drilling fluid flow rate.

The power output of the motor is calculated from a determination of the torque and rotor rotation rate. The power output is simply the product of the variation of torque with pressure differential, and the variation of rotation rate with pressure differential.

DESCRIPTION OF THE PREFERRED EMBODIMENT

Figure 2:
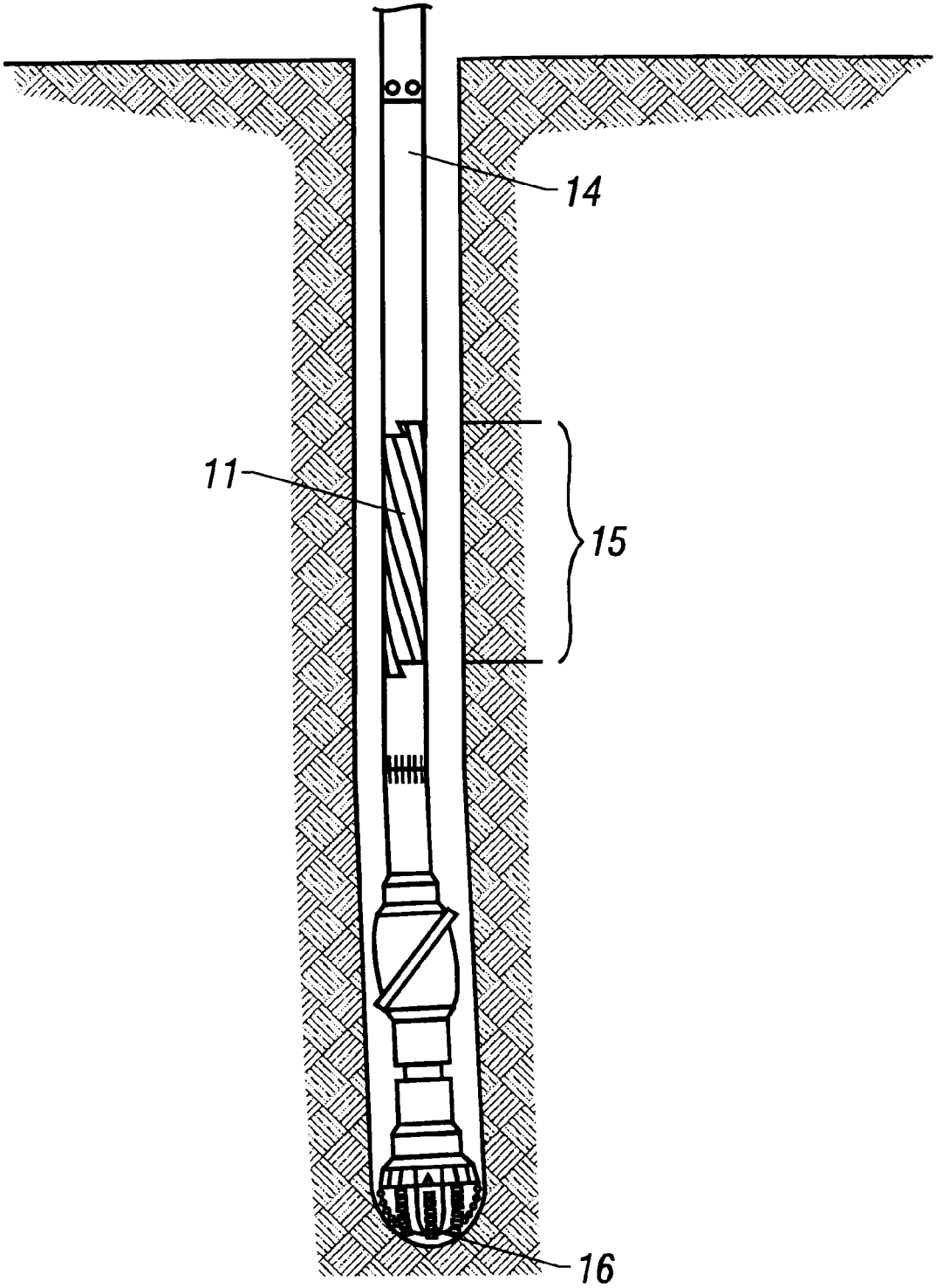
FIG. 2 is a diagram of the components of a drilling system that are relevant to the present invention.

FIG. 2 shows the components of a drilling system that are relevant to the present invention. Drilling fluid is pumped through a drill string 14 and flows down to a drilling motor 15. The fluid flows through the motor 15 causing the rotor 11 to rotate and thereby rotating the drill bit 16 which is mechanically linked to the rotor 11.

Figure 3:
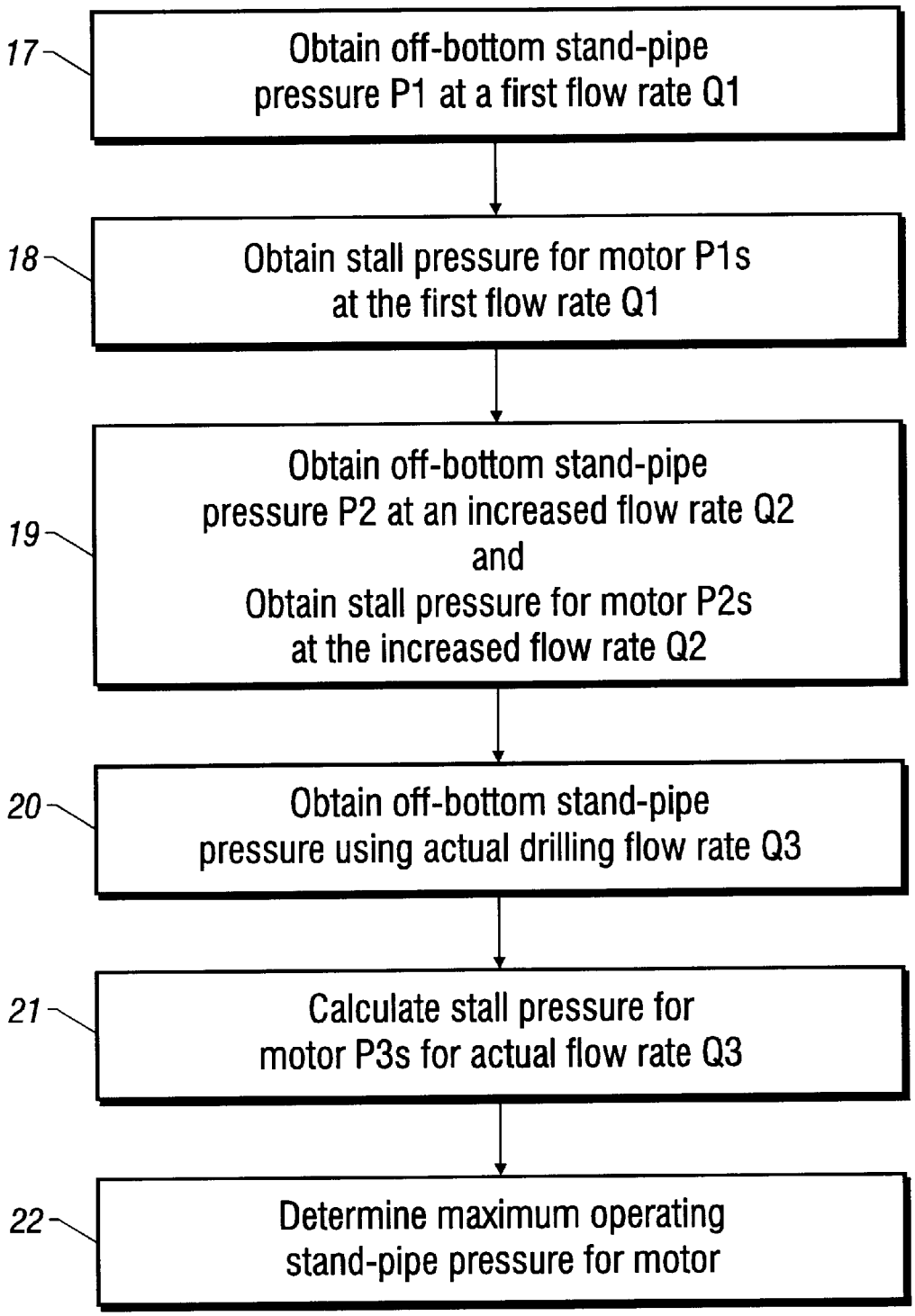
FIG. 3 is a flow diagram of the steps in the present invention.

FIG. 3 is a flow diagram of the steps performed in this invention. The first step 17 is to determine the off-bottom stand-pipe pressure of the drilling system at a flow rate that is less than the actual flow rate during drilling operations. In this step, the motor position in the borehole is such that the drill bit 16 is a small distance (usually in the range of 1 to 10 feet) from the bottom of the borehole. The drilling fluid flow rate (Q1) is then set at a low value, preferably no more than one half the recommended maximum flow rate for the motor 15. Surface equipment records the stand-pipe pressure with the motor in this "off-bottom" position and designates this pressure as P1.

While maintaining the flow rate at Q1, the next step 18 is to slowly lower the drill bit against the formation at the bottom of the borehole and apply weight to the bit until the bit can no longer rotate. At this point, the motor is in a stalled condition. Surface equipment again records the stand-pipe pressure and designates this pressure as P1s. With the knowledge of the two pressures P1 and P1s, it is possible to determine the differential pressure ΔP1 across the motor for the flow rate Q1. The differential pressure ΔP1 is simply the difference between the stand-pipe pressure with the motor stalled, P1s, and the off-bottom stand-pipe pressure P1.

The next step 19 is to repeat the previous steps, but at an increased fluid flow rate Q2. By repeating these two steps, a new off-bottom pressure is measured and designated as P2. A new stall pressure P2s also results from this process. The resulting differential pressure at this fluid flow rate is ΔP2. Now, with the motor in the "off-bottom" position, and the flow rate set to the actual drilling flow rate Q3, the next step 20 obtains the "off-bottom" stand-pipe pressure, P3, with the same technique used to determine P1 and P2. By knowing the differential pressure ΔP at each of the previous flow rates, and the off-bottom stand-pipe pressure P3, there can be a determination of the differential pressure ΔP3 needed to stall the motor at the actual drilling flow rate Q3. The stall pressure P3s is the sum of the off-bottom stand-pipe pressure P3 and the differential pressure ΔP3.

Figure 4:
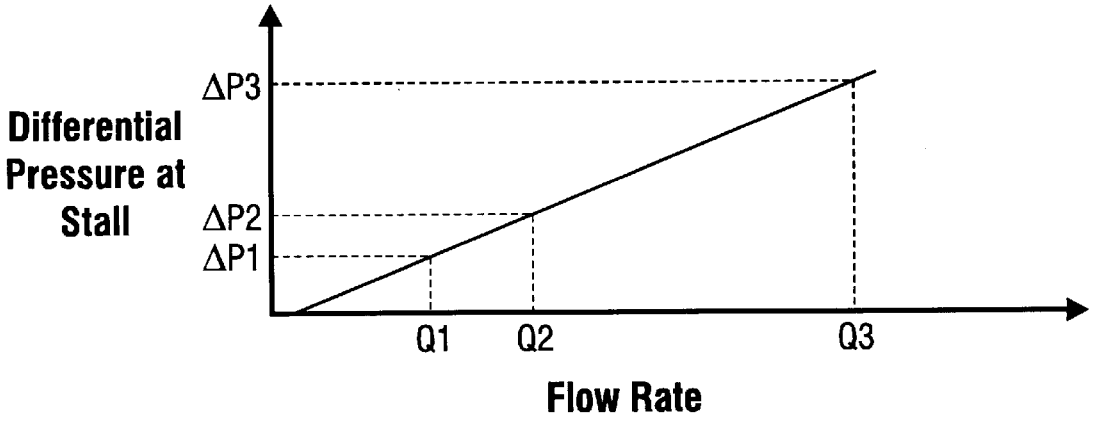
FIG. 4 is a plot of the differential pressure across the motor at stall versus flow rate.

Experiments have shown that there is a linear relationship between flow rate and differential pressure at stall as shown graphically in FIG. 4. Therefore, by using extrapolation techniques, one can calculate the approximate differential pressure necessary to stall the motor at any desired drilling flow rate (Q3). An extrapolation equation for determining the differential pressure at stall ΔP3 is:

$$\frac{Q3 - Q1}{Q3 - Q2} = \frac{\Delta P3 - \Delta P1}{\Delta P3 - \Delta P2} \quad [1]$$

Solving this equation for ΔP3 results in the following equation:

$$\Delta P3 = \frac{\Delta P1(Q2 - Q3) + \Delta P2(Q3 - Q1)}{Q2 - Q1} \quad [2]$$

where ΔP1 is the differential pressure between P1 and P1s, ΔP2 is the differential pressure between P2 and P2s and Q1 and Q2 are flow rates as previously defined. This extrapolation operation results in a calculated pressure differential ΔP3 at the actual drilling flow rate Q3. Adding the off-bottom pressure value P3 to the value of ΔP3 results in a predicted stand pipe pressure at stall P3s as indicated at 21 in FIG. 3.

Figure 1:
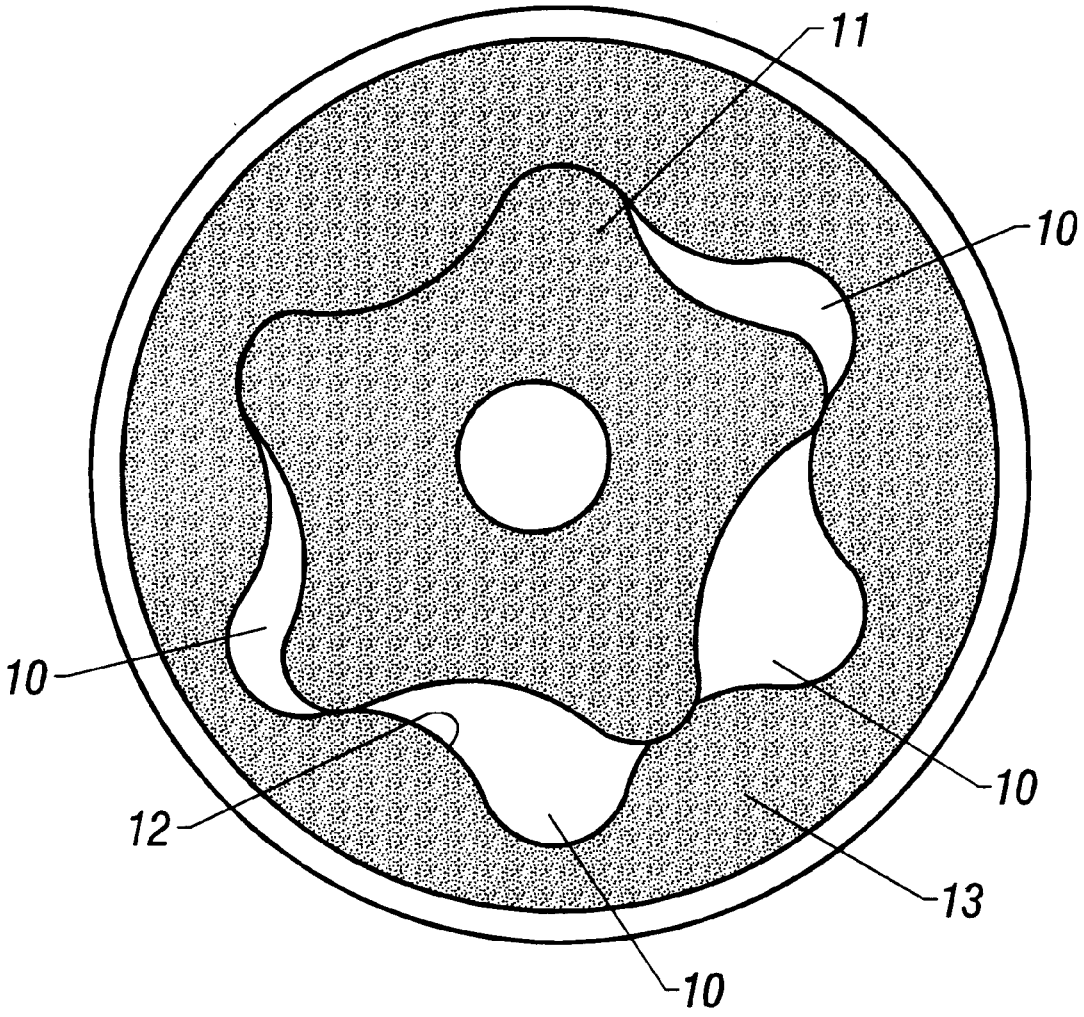
FIG. 1 is a cross-section view of a drilling motor showing the rotor and stator lobes.
Figure 5:
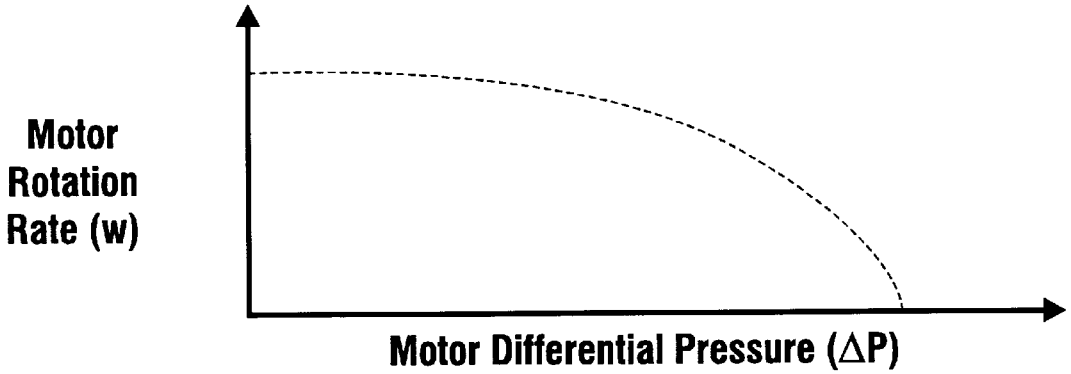
FIG. 5 is a plot of the motor rotation rate versus differential pressure.

The next step of the invention is to calculate the power output of the motor. At this point, it is desirable to determine the rotation rate of the rotor when no torque is applied at the bit. With knowledge of the geometry of the rotor and stator, it is possible to determine the rotor rotation rate at any given fluid flow rate. Referring to the geometry of the motor in FIG. 1, the area 10 through which fluid can flow is the difference between the area within the stator 13 and the area of the rotor 11. Knowing the desired flow rate and the flow area, one can determine the rotation rate. This rotation rate is known as the "free running rotation rate" and is designated as ω3 at a flow rate Q3. Now with information about the rotation rate and pressure differential available from the previously described procedure, two points are generated on the rotation rate versus differential pressure curve as shown in FIG. 5. It can be assumed that a characteristic curve can be generated which passes through the two points with the following form:

$$\omega = \omega_{\max} - \frac{\omega_{\max}\Delta P^n}{\Delta P^n_{\max}} \quad [3]$$

$\omega_{max}$ is the free-running rotation rate. The constant "n" is derived from torque and motor rotary speed experiments. Data from experiments measuring the pressure across the motor at stall (no rotation) indicate that n equals 2.5 for a 6.75 inch motor with a 5 lobe stator and 4.8 stages. This constant is a representation of the relationship between motor rotary speed and differential pressure ΔP as shown by the curve plotted in FIG. 5. To determine "n", a curve fit is performed on the curve such as the one in FIG. 5.

To this point, the present invention has described steps that calculate off-bottom rotation rate, ω3, steps that measure the off-bottom stand-pipe pressure, P3, and calculate the stall pressure, P3s, at the drilling flow rate. In addition, the entire curve which describes the relationship between differential pressure and rotation rate of the rotor at the drilling flow rate can be generated from the known information.

The next step is to calculate the change in power output of the motor with differential pressure. In order to do this it is necessary to obtain two pieces of information: the variation of torque (T) with differential pressure, and the variation of rotation rate (ω) with differential pressure. The power output is then simply the multiple of these two values and a constant as shown in the equation below where T is in units of foot-pounds, ω is in units of revolutions per minute, and Power is in horsepower.

$$\text{Power} = \frac{1}{5252}\omega T \quad [4]$$

The relationship between torque, T, and differential pressure is also a linear relationship. For a certain ΔP, one can determine the stall torque. The torque, T, at any differential pressure, ΔP, is given by the relationship:

$$T = 3.064\ \Delta P\ V\ E \quad [5]$$

In this equation [5], ΔP is in units of pounds per square inch, V is the number of gallons of fluid passing through the motor per revolution of the rotor, and E is the efficiency of the motor as defined by:

$$E = \frac{(100 - 5N_s)}{100} \quad [6]$$

where $N_S$ is the number of stator lobes. The torque varies linearly with differential pressure across the motor and for the actual flow rate is given by the stall torque, T3s, at ΔP3. Hence, the torque at any pressure differential ΔP, is given by:

$$T = \Delta P\frac{T3s}{\Delta P3} \quad [7]$$

Thus, the relationship between power and differential pressure is given by:

$$\text{Power} = \frac{1}{5252}\left(T3s\frac{\Delta P}{\Delta P3}\right)\left(\omega_{\max} - \frac{\omega_{\max}\Delta P^n}{(\Delta P3)^n}\right) \quad [8]$$

To evaluate the optimum operating differential pressure, it is necessary to first find the maximum power output. This is found by differentiating equation [7] with respect to differential pressure and equating to zero. Thus, the obtained maximum power is:

$$\text{Power}_{\max} = \left(\frac{(\Delta P3)^n}{n+1}\right)^{\frac{1}{n}} \quad [9]$$

Figure 6:
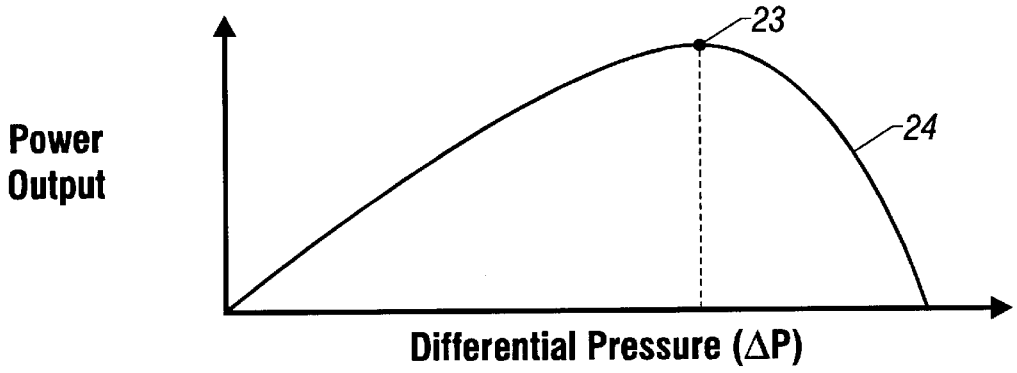
FIG. 6 is a plot of the power output of the motor versus differential pressure.
Figure 7:
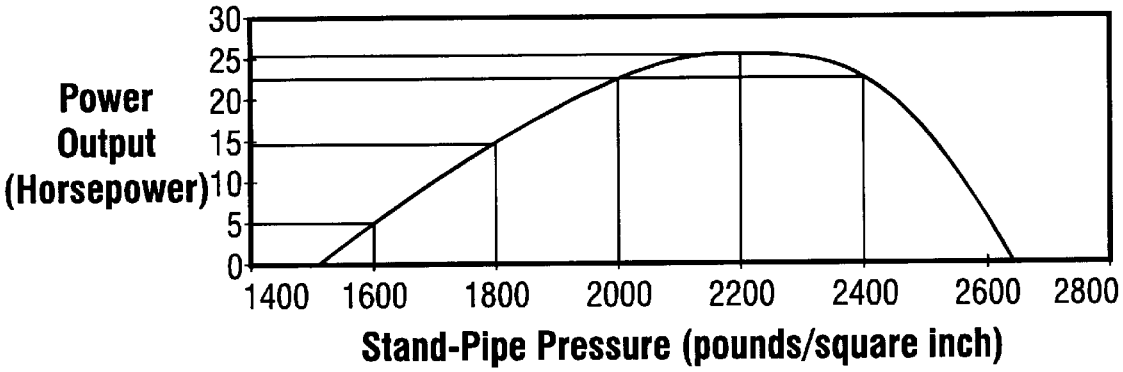
FIG. 7 is a plot of the power output of the motor versus stand pipe pressure.

Hence, by substitution of equation [9] into equation [8], and then solving to find the positive and real values of differential pressure, one can determine the differential pressure across the motor at the drilling flow rate which produces maximum power. FIG. 6 is a plot of the power output of the motor versus differential pressure. Indicated on the curve in FIG. 6 is the point 23 on the power output curve 24 of the maximum power of the motor. Using equations [8] and [9], the full power curve shown in FIG. 7 is generated for the motor at the drilling flow rate, and the recommended stand-pipe pressure for optimal operation. Since power is actually the motor rotation rate multiplied by the torque, this power curve is the product of the rotation rate versus differential pressure curve shown in FIG. 5 and the relationship between torque and differential pressure. This product results in the power output versus stand-pipe pressure curve shown in FIG. 7. In this curve, the maximum power output of the motor is the power at the top point of the curve. From this curve, it is possible to determine the stand-pipe pressure for the motor at maximum power (FIG. 3, step 22).

In an experimental application of the method to determine the stall pressure at the actual fluid flow rate, a first calibration was made using a fluid flow rate of 104 gallons per minute. The off-bottom pressure at this flow rate was 830 pounds/square inch. As the bit was lowered against the formation and weight applied to the bit, the motor stalled at 1424 pounds/square inch. In a second calibration, at a flow rate of 116 gallons per minute, the off-bottom pressure was 1190 pounds/square inch. In this calibration, the motor stalled at 1983 pounds per square inch. An off-bottom pressure was then taken at the flow rate (138 gallons per minute) at which actual drilling was to occur. This pressure was 1488 pounds/square inch. From extrapolation calculations, the motor stall pressure during actual drilling should be approximately 2634 pounds/square inch. In this example, the optimal drilling pressure should be approximately 2200 pounds/square inch, which is approximately 80 percent of the stall pressure. To establish the extent of degradation of the motor with time, the procedure of the present invention is carried out at various stages of the motor run at the same drilling flow rate. The power curves thus produced are then compared directly and any performance deterioration quantified.

The description of this invention is with reference to a particular embodiment, but variations within the spirit and scope of the present invention will occur to those skilled in the art. Those skilled in the art will recognize that numerous variations and modifications may be made without departing from the scope of the present invention. Accordingly, it should be understood that the forms of the invention described hereinabove are exemplary, and are not intended as limitations on the scope of the invention, which should be defined only by the claims, appended hereto.

We claim:

1. A method for determining the stall pressure of a downhole drilling motor, comprising the steps of:

a) measuring a first off-bottom stand-pipe pressure and a first stall pressure for said drilling motor at a first drilling fluid flow rate, said first flow rate being less than the actual fluid flow rate during drilling;

b) measuring a second off-bottom stand-pipe pressure and a second stall pressure for said drilling motor at a second drilling fluid flow rate;

c) measuring a third off-bottom stand-pipe pressure at a third drilling fluid flow rate, said third flow rate being the actual flow rate used during drilling operations;

d) calculating a differential pressure across said drilling motor at said actual drilling fluid flow rate and while said motor is stalled using said previously measured stand-pipe pressures and stall pressures; and e) calculating the stall pressure at said actual flow rate during drilling from said off-bottom stand-pipe pressure in step (c) and said differential pressure in step (d).

2. The method of claim 1 wherein said off-bottom stand-pipe pressures are determined by:

positioning said motor in a wellbore such that a drill bit attached to said motor is not in contact with the bottom of said wellbore;

flowing drilling fluid through said motor at a previously determined flow rate; and measuring the stand-pipe pressure at the surface.

3. The method of claim 1 wherein said first and second stall pressures are determined by:

positioning said motor in a borehole such that a drill bit attached to the lower end of said motor is against the bottom of said borehole;

flowing drilling fluid through said motor causing said motor to rotate said drill bit;

applying weight to said drill bit until said motor can no longer rotate; and measuring the stand-pipe pressure at the surface, said stand-pipe pressure measurement being the stall pressure.

4. The method of claim 1 wherein said stall pressure at said actual drilling flow rate is the sum of said calculated differential pressure at said actual flow rate and said third off-bottom stand-pipe pressure.

5. The method of claim 4 further comprising after step (c), the step of calculating the differential pressure across said motor at stall for said first flow rate and said differential pressure across said motor at stall for said second flow rate by subtracting the off-bottom pressure at each said flow rate from the stall pressure at said same flow rate.

6. The method of claim 5 wherein said differential pressure across said motor at said actual drilling fluid flow rate and while said motor is stalled is calculated by extrapolation using said calculated differential pressures and said flow rates.

7. The method of claim 1 further comprising the step of:

f) calculating the maximum power and associated stand-pipe pressure for said drilling motor.

8. The method of claim 7 further comprising the step of determining the optimum operating stand-pipe pressure at said actual drilling flow rate, said optimum stand-pipe pressure being that pressure at which said motor generates maximum power.

9. The method of claim 1 wherein said first drilling fluid flow rate is approximately one-half the maximum flow rate for said drilling motor.

10. The method of claim 1 wherein said second drilling fluid flow rate is greater than said first drilling fluid flow rate, but less than said actual drilling fluid flow rate.

11. The method of claim 2 wherein said drill bit is approximately 1 to 10 feet from the bottom of said wellbore.

12. A method for calculating the pressure differential across a drilling motor during drilling operations comprising the steps of:

a) determining a first off-bottom stand-pipe pressure (P1) and a first stall pressure for said drilling motor (P1s) at a first drilling fluid flow rate (Q1), said flow rate being less than the actual fluid flow rate during drilling (Q3);

b) determining a second off-bottom stand-pipe pressure (P2) and a second stall pressure for said drilling motor (P2s) at a second drilling fluid flow rate (Q2);

c) determining a third off-bottom stand-pipe pressure at a third drilling fluid flow rate (Q3), said third flow rate being the actual flow rate used during drilling operations; and d) calculating a differential pressure across said drilling motor (ΔP3) at said actual drilling fluid flow rate using said previously determined stand-pipe pressures and stall pressures.

13. The method of claim 12 wherein said differential pressures across said motor for said first and second flow rates are determined by subtracting the off-bottom pressure at each said flow rate from the stall pressure at said same flow rate.

14. The method of claim 12 wherein the differential pressure across said motor at stall and at said actual drilling fluid flow rate (ΔP3) is calculated by extrapolation using the equation:

$$\frac{Q3 - Q1}{Q3 - Q2} = \frac{\Delta P3 - \Delta P1}{\Delta P3 - \Delta P2}$$

where ΔP1 is the pressure difference between P1 and P1s, and ΔP2 is the pressure difference between P2 and P2s.

15. A method for determining the power output of a drilling motor under downhole conditions comprising the steps of:

a) determining a differential pressure across said drilling motor under downhole conditions;

b) determining the variation in torque with respect to said differential pressure across said motor during actual drilling operations;

c) determining the variation of the motor rotation rate with respect to the differential pressure across the motor during actual drilling operations; and d) calculating said power output by multiplying said variation in torque by said variation of motor rotation rate.

16. The method of claim 15 wherein the relationship between power output, motor rotation rate (ω) and torque (T) is:

$$\text{Power} = \frac{1}{5252}\omega T,$$

where Power is in units of horsepower, ω is in revolutions per minute, and T is in foot-pounds.

17. The method of claim 15 further comprising the step of determining a maximum stand-pipe pressure for said motor.

18. The method of claim 17 further comprising the step of determining an optimum operating stand-pipe pressure from said maximum stand-pipe pressure.

* * * * *